US005230431A

United States Patent [19]

Andrén

[11] Patent Number: 5,230,431

[45] Date of Patent: Jul. 27, 1993

[54] VERTICAL SCREENING DEVICE WITH FEEDING SCREW

[75] Inventor: Ingmar Andrén, Lindesberg, Sweden

[73] Assignee: Lindema Kommanditbolag, Lindesberg, Sweden

[21] Appl. No.: 773,866

[22] PCT Filed: Mar. 18, 1991

[86] PCT No.: PCT/SE91/00205

§ 371 Date: Oct. 25, 1991

§ 102(e) Date: Oct. 25, 1991

[87] PCT Pub. No.: WO91/14516

PCT Pub. Date: Oct. 3, 1991

[30] Foreign Application Priority Data

Mar. 23, 1990 [SE] Sweden ..... 9001074

[51] Int. Cl.[5] ..... B07B 1/22

[52] U.S. Cl. ..... 209/243; 198/658; 198/659; 209/247; 209/301

[58] Field of Search ..... 209/303, 304, 301, 243, 209/247, 252, 254, 913, 270, 263; 198/658, 659, 676

[56] References Cited

U.S. PATENT DOCUMENTS

| | | | |
|---|---|---|---|
| 2,397,305 | 3/1946 | Wheat | 198/676 |
| 3,194,385 | 7/1965 | Barnese | 198/659 X |
| 4,265,738 | 5/1981 | Goncharov et al. | 209/301 X |
| 4,467,910 | 8/1984 | Siwersson et al. | 198/658 X |
| 4,534,859 | 8/1985 | Andren | 209/301 |
| 4,645,590 | 2/1987 | Satake | 209/304 |
| 4,957,618 | 9/1990 | Andren | 209/303 |

FOREIGN PATENT DOCUMENTS

| | | |
|---|---|---|
| 1501008 | 5/1980 | Denmark . |
| 0185843 | 2/1986 | European Pat. Off. . |
| 434349 | 7/1984 | Sweden . |
| 455674 | 1/1988 | Sweden . |
| 466005 | 12/1991 | Sweden . |
| 239703 | 3/1969 | U.S.S.R. . |
| 435867 | 12/1974 | U.S.S.R. . |
| 1256785 | 9/1986 | U.S.S.R. . |
| 1458003 | 2/1989 | U.S.S.R. . |
| 336252 | 10/1930 | United Kingdom . |

*Primary Examiner*—Donald T. Hajec

*Attorney, Agent, or Firm*—Roylance, Abrams, Berdo & Goodman

[57] ABSTRACT

A vertical screen device for a separator is disclosed. The screening device comprises a vertical cylindrical screen with a feed screw housed within the screen and cooperating with the screen. The feed screw is caused to rotate while the screen is held stationary. The improvements of the invention are provided by having the feed screw make an angle with the surface of the screen over at least a portion of its length. Further, the feed screw is made up partially of a radially inwardly non-yielding portion, and a radially outwardly aligned elastic portion.

3 Claims, 2 Drawing Sheets

VERTICAL SCREENING DEVICE WITH FEEDING SCREW

SUMMARY OF THE INVENTION

The present invention relates to a feeding screw for a vertical screening device of a separator, said screening device comprising a cylindrical, rotatable screen, a bearing means fixedly connected with the screen, and a non-rotatable feeding screw which coacts with the screen and is supported by the bearing means, the feeding screw being connected, via a link extending beyond the cylindrical surface of the screen, to the stationary separator housing, and said feeding screw having a non-yielding helical portion and an elastic helical portion.

Such a device is a disclosed in U.S. Pat. No. 4,957,618 and can be found in e.g. separators according to U.S. Pat. No. 4,534,859.

In feeding screws according to U.S. Pat. No. 4,957,618 it happens however that when screening e.g. granular material which rolls easily, such as rape, a certain amount rolls down the screw along the screw upper side at a distance from the cylindrical surface of the screen, without engaging the screen, and thus without being able to pass through the perforations of the screen. As a result, a granular material can pass through the last screening device without being separated and leaves the separator as waste together with separated refuse. The waste can amount to a few percent.

The object of the present invention is to provide a feeding screw for a vertical screening device which produces a considerably smaller amount of waste as compared to prior art screws.

A further object of the invention is to provide an improved feeding screw which can readily be used in existing separators.

According to the invention, these objects are achieved by a feeding screw as described above, which is characterised in that at least a section of the feeding screw between the uppermost and lowermost portion thereof makes an acute angle with the cylindrical surface of the screen, the upper side of the feeding screw in this section being inclined downwards from the interior of the screw towards the cylindrical surface of the screen.

In experiments with the inventive feeding screw, waste has been produced in an amount of some percent of the waste obtained in connection with the prior art feeding screw for the same granular material.

BRIEF DESCRIPTION OF THE DRAWINGS

Preferred embodiments of the invention will now be described for the purpose of exemplification, with reference to the accompanying drawings in which.

Figure 1:
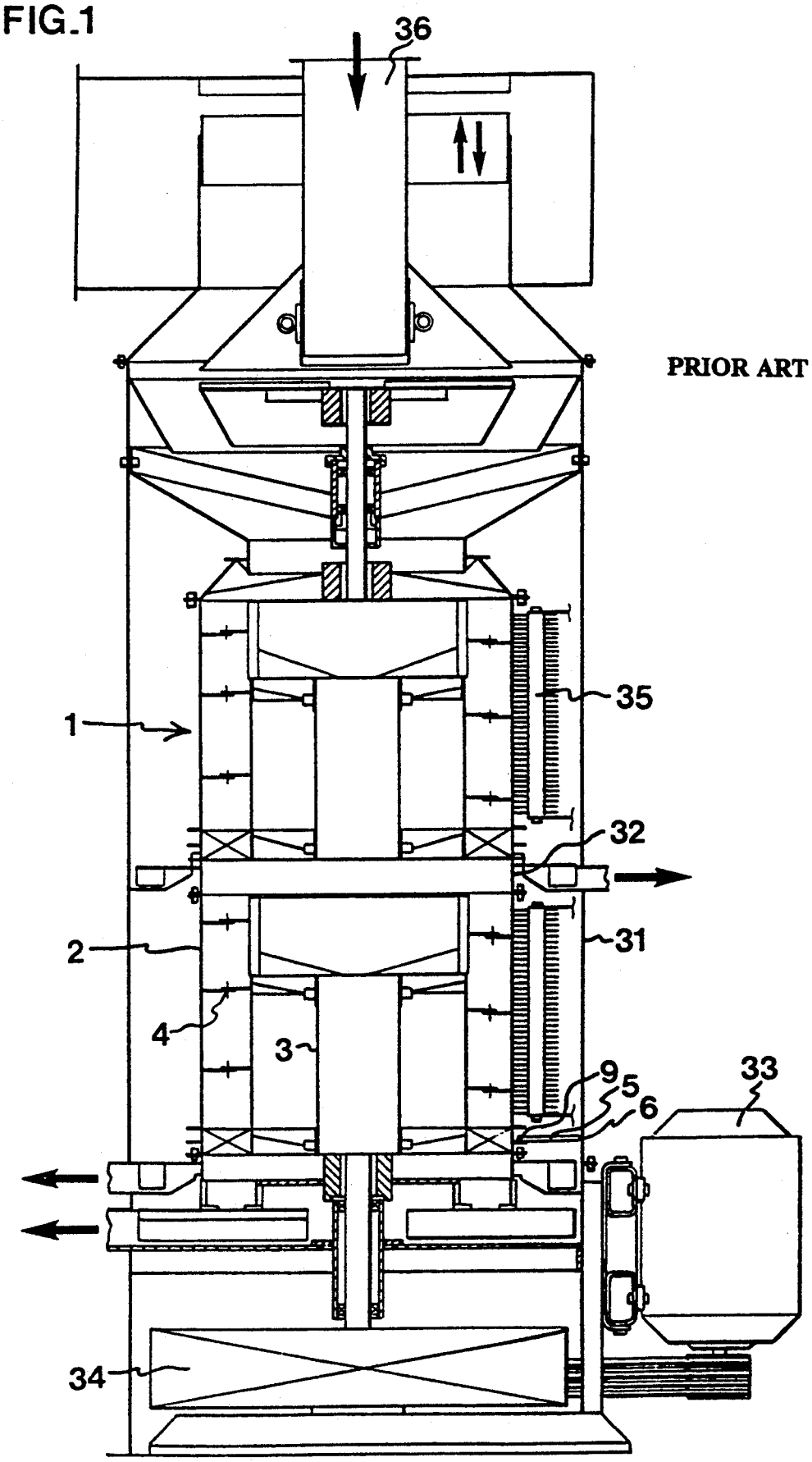
FIG. 1 is a longitudinal section of a prior art separator having two vertical screening devices.

With reference first to FIG. 1, the screening device 1 comprises a cylindrical, rotatable screen 2, a bearing means 3 fixedly connected with the screen 2, and a nonrotatable feeding screw 4 which coacts with the screen 2 and is supported by the bearing means 3. The feeding screw 4 is connected, via a link 5 extending beyond the cylindrical surface of the screen 2, to a fixed point 6 in order to keep the feeding screw stationary while the screen 2 rotates. The fixed point 6 is preferably arranged at the stationary housing 31 of the separator, see FIG. 1. For a detailed presentation of a suitable mounting of the link 5 in the screen 2 and in the housing 31, reference is made to the above-mentioned U.S. Pat. No. 4,957,618.

The bearing means 3 for the feeding screw 4 constitutes a fixed connection transferring rotary and torsional forces and positioned between the upper and lower end portions 7 and 8 of the screening device 1 which suitably consist of flanges. The cylindrical screen 2 is, however, fixedly connected with one end portion 7 only, there being a space between the cylindrical screen 2 and the other end portion 8. This space is utilised for the link 5 of the feeding screw 4.

The link 5 of the feeding screw 4 is attached to a flange 9 which is fixedly connected with the feeding screw 4 and positioned directly opposite the end flange 8 and directly opposite a corresponding flange 10 adjacent the cylindrical screen 2. Sealing means 11 are arranged between the flanges 8, 9 and 10. According to the drawing, the sealing means 11, which consist of brushes, are arranged at the flange 9, while they slide against the flanges 8 and 10.

As shown in FIG. 1, the link 5 is attached to the exterior of the flange 9 outside the sealing means 11, which means that the link 5 does not conflict therewith in any way.

The bearing means 3 comprises a cylindrical pipe 12 which is lower than the screening device 1. The feeding screw 4 is mounted round the pipe 12 by means of a tubular hub 13 of substantially the same height, while the feeding screw 4 with a completely open portion extends above the tubular hub 13. The hub 13 suitably comprises a thinwalled steel cylinder on whose outside a non-yielding helical portion 14 of the feeding screw 4 in the form of a steel spiral is wound and attached thereto by welding. An elastic helical portion 15 is attached to the entire length of the non-yielding helical portion 14, forms a section of the feeding screw and extends into engagement with the inside of the cylindrical screen 2. The constructional details of the feeding screw 4 will be described more closely below.

The tubular hub 13 is on its inside provided with rollers 16 and 17 which, for the purpose of guiding the screw 4 both radially and axially, are adapted to roll on tracks 18 and 19 arranged on the outside of the cylindrical pipe 12 of the bearing means 3. The rollers 17 which guide the screw 4 radially are suitably six in number and uniformly distributed in pairs along the circumference, while the rollers 16 which guide the screw 4 axially are suitably four in number and diametrically arranged in pairs. The tracks 18 and 19 are preferably plastic rings.

As disclosed in the above-mentioned U.S. Pat. No. 4,957,618, the bearing means 3 comprises a number of axially directed bars 20 mounted above the cylindrical pipe 12 and uniformly distributed along the inner circumference of the feeding screw 4. Moreover, a radially directed disc 21 is mounted between the cylindrical pipe 12 and the axially directed bars 20. As a result of this and since the bearing means 3 is directly or indirectly connected to the flanges 7 and 8 at its upper and lower part, the bearing means 3 serves as a transfer means for rotary and torsional forces between said flanges 7 and 8.

The cylindrical screen 2 is at its lower end fitted with an inwardly directed cone 22 which conducts the material to be separated so that it does not unnecessarily come into contact with the brushes which serve as sealing means 11.

With reference to FIG. 1, two screening devices 1 according to the present invention can be interconnected just as they are in the prior art in that the flange 7 of one device is connected directly with the flange 8 of the other. Normally, as in the abovementioned U.S. Pat. No. 4,534,859, use is however made of a flanged ring 32 or the like as coupling means. A motor 33 attached to the housing 31 of the separator drives by a transmission 34, e.g. the transmission according to the last-mentioned patent, the screen 2 and the bearing means 3 which are connected with each other, while the feeding screw 4 is kept stationary by the link 5. A cleaning roller 35 engages the outside of the screen 2 in order to keep it clean.

In operation of the separator, the material to be separated, such as cereals or rape, is introduced through a pipe 36 and part of the material eventually falls down into the screening device 1. For a description of the principles of screening in the separator, reference is made to the above-mentioned U.S. Pat. No. 4,534,859. The major part of the material passes into the bearing means 3 of the screening device in the space above the rotating disc 21. Here the material is rotated by vanes 23 and thrown out by centrifugal force between the bars 20 and against the rotating screen 2. By coaction between the feeding screw 4 and the screen 2, the unscreened material is prevented from falling freely along the screen inside, and the screening operation is promoted.

When separating especially granular material which rolls easily, such as rape, a certain amount rolls down the upper side of the feeding screw at a distance from the cylindrical surface of the screen, without engaging the screen and thus without penetrating the perforations in the screen. This is above all disadvantageous for the lowermost screening device, where waste thus is produced. This drawback can in every essential respect be eliminated when the feeding screw is designed in accordance with the teachings of the present invention.

Figure 2:
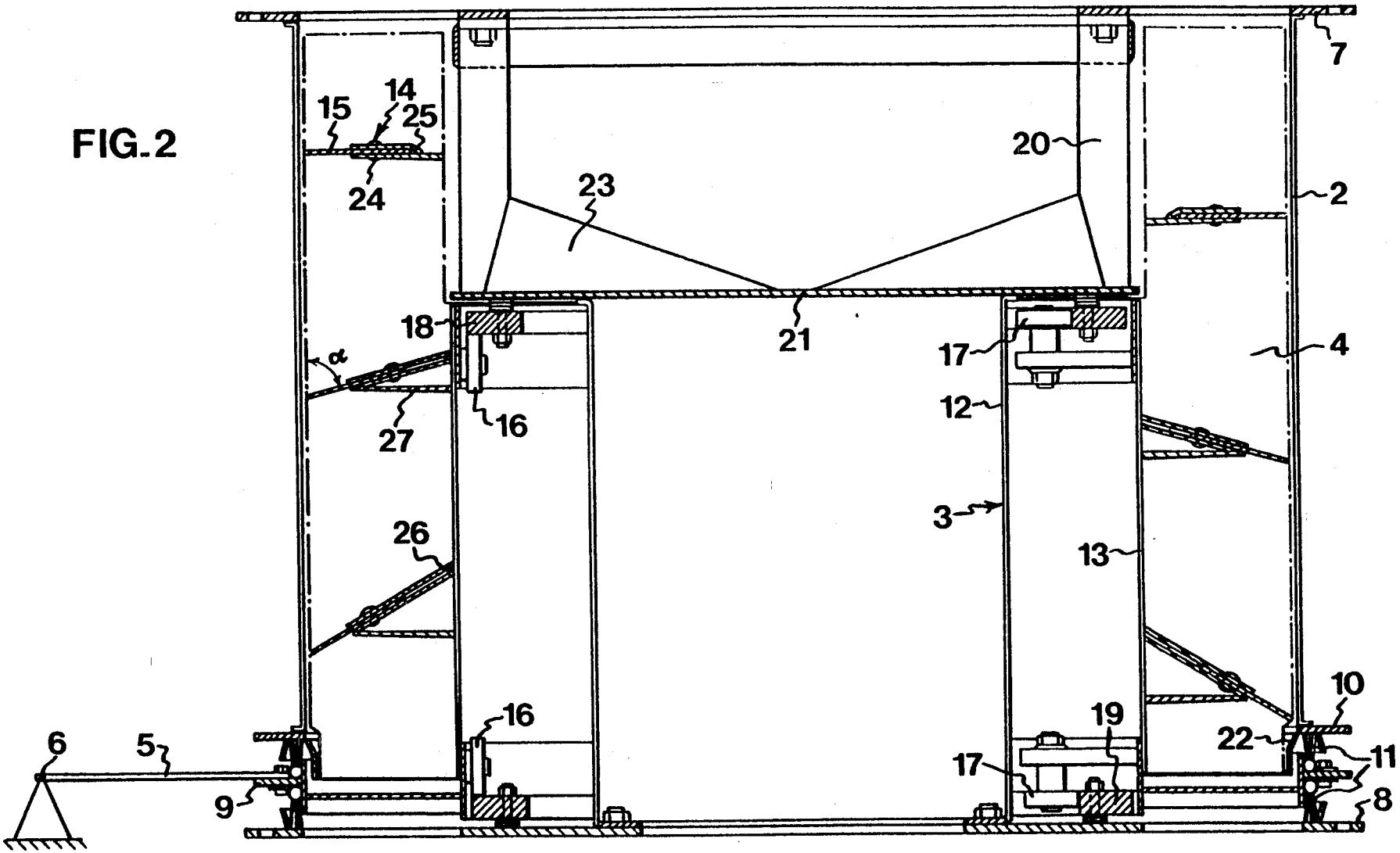
FIG. 2 is an enlarged longitudinal section of one of the vertical screening devices, showing one embodiment of the feeding screw.

With reference to FIG. 2, the feeding screw 4 comprises a non-yielding helical portion 14, preferably of steel, and an elastic helical portion 15, preferably of rubber, as mentioned above. The upper sides of said portions 14 and 15 are substantially aligned with each other, the portion 15 being secured to the portion 14 by means of adhesion, a riveted joint or in some other suitable manner. FIG. 2 illustrates the elastic helical portion 15 clamped between two metal helical portions forming the non-yielding helical portion 14. Rivets 24 press the metal helical portions together and clamp the elastic helical portion 15. By means of an upsetting 25 of one of the metal helical portions, or a helical insert 26, the metal helical portions are held at a suitable and substantially parallel distance from one another. If required, a helical bracket 27 can also be mounted to support the lowermost metal helical portion and thus be included in the non-yielding helical portion 14. Furthermore, if required, the feeding screw 4 can be formed with two or more inputs or threads.

According to the present invention, the feeding screw 4 is designed in such a manner that at least a section of the feeding screw between the uppermost portion (at the upper end portion 7) and the lowermost portion (at the lower end portion 8) makes an acute angle $\alpha$ with the cylindrical surface of the screen 2. The upper side of the feeding screw (the upper side of the helical portions 14 and 15, also referred to as "run-off ramp") in this section is inclined downwards from the interior of the screw (at the hub 13) towards the screen 2. In this context, the designation "section" means entire turns and/or parts of turns of the interconnected helical portions 14 and 15 of the feeding screw. In the embodiment according to FIG. 2, the inclination of the upper side of the screw 4 increases continuously in a direction from the uppermost portion, where the upper side is shown to be substantially horizontal, towards the lowermost portion where the upper side is inclined at angle of about 45° to the vertical plane. The greatest inclination thus is to be found in the lowermost part of the feeding screw. Owing to this design of the feeding screw, material on the screw upper side is forced to slide against the cylindrical surface of the screen, where it is rotated along with the screen.

According to an alternative embodiment of the feeding screw, the inclination of the screw upper side is constant. If desired, the inclination can also be increased gradually. Moreover, the upper side of the feeding screw can be horizontally oriented at the uppermost portion (at 7), have a constant inclination at the lowermost portion (at 8), and be interrupted between the horizontally oriented upper part and the lower part with a constant inclination of the feeding screw. Combinations and variants of the embodiments of the feeding screw as described are, of course, possible within the scope of the invention.

Thus, the upper side of the feeding screw can be curved instead of substantially flat as shown in FIG. 2. Besides, the feeding screw can, if desired, be provided with radially directed guide bars in order to guide the material to be separated against the screen.

The invention is not limited to that described above and shown in the drawing, but can be modified within the scope of the claims.

I claim:

1. A vertical screening device comprising a vertical cylindrical screen, a vertical feed screw housed within said screen and cooperating with said screen; said feed screw having an upper surface, and an upper end and a lower end; means to hold said feed screw stationary, means to rotate said screen about its vertical axis, said feed screw comprising a non-yielding helical portion and an elastic helical portion with said elastic portion being aligned with and positioned radially outwardly of said non-yielding portion, at least a portion of the length of said feed screw being inclined to cause said upper surface of said feed screw in said portion of the length of said feed screw to make an acute angle with said cylindrical screen, and said acute angle having a smallest value closest to said lower end and larger values at locations spaced away from said lower end towards said upper end.

2. The device of claim 1, wherein said angle decreases continuously.

3. The device claim 1, means for securing said non-yielding and elastic portions of said feed screw together, said securing means including helical insert means for holding said non-yielding and elastic portions at a predetermined distance from each other.

* * * * *